US006380720B1

(12) United States Patent
Cain et al.

(10) Patent No.: US 6,380,720 B1
(45) Date of Patent: Apr. 30, 2002

(54) VOLTAGE REGULATOR FOR DUAL POWER SOURCE NETWORKS

(76) Inventors: Steven L. Cain, 1619 Stepstone Way, Lawrenceville, GA (US) 30043; Michael G. Ellis, 12230 Leeward Walk Cir., Alpharetta, GA (US) 30202

( * ) Notice: Subject to any disclaimer, the term of this patent is extended or adjusted under 35 U.S.C. 154(b) by 0 days.

(21) Appl. No.: 09/755,990

(22) Filed: Jan. 5, 2001

Related U.S. Application Data

(60) Provisional application No. 60/174,449, filed on Jan. 5, 2000.

(51) Int. Cl.[7] ..... G05F 1/56

(52) U.S. Cl. ..... 323/268; 323/284; 323/274

(58) Field of Search ..... 323/268, 273, 323/274, 282, 284, 351; 363/125, 127

(56) References Cited

U.S. PATENT DOCUMENTS

| | | | | | |
|---|---|---|---|---|---|
| 4,502,152 | A | * | 2/1985 | Sinclair | 323/268 |
| 4,959,786 | A | * | 9/1990 | Glowczewski et al. | 363/424 |
| 5,034,676 | A | * | 7/1991 | Kinzalow | 323/268 |
| 5,083,078 | A | * | 1/1992 | Kubler et al. | 323/268 |
| 5,548,204 | A | * | 8/1996 | Armstrong, II et al. | 323/265 |
| 5,864,225 | A | * | 1/1999 | Bryson | 323/268 |

* cited by examiner

*Primary Examiner*—Adolf Deneke Berhane
(74) *Attorney, Agent, or Firm*—Gaines P. Carter

(57) ABSTRACT

A voltage regulator for determining whether a primary power source is present in a dual power coaxial cable network. The present invention consists of a primary power source for producing a first voltage and a secondary power source for producing second voltage. A common input combines the first voltage with the second voltage. A voltage regulator produces an output voltage in either linear mode or pulsating mode based on the magnitude of the combined first and second voltages received from the common input.

8 Claims, 3 Drawing Sheets

VOLTAGE REGULATOR FOR DUAL POWER SOURCE NETWORKS

This application claims priority from Provisional Application No. 60/174 449 filed Jan. 5, 2000.

FIELD OF INVENTION

This invention relates to dual power source networks and, more specifically, to voltage regulating power supply circuits that are operable to output a regulated dc voltage in linear and switching modes based on the status of the network. This invention also relates to dual power supply coaxial cable network monitoring systems.

BACKGROUND

As residential applications for broadband communications continue to grow, coaxial cable networks, which form the infrastructure for the majority of such systems, are being adapted for multiple uses. Such networks can be adapted to supply power to the various electronic components in residential interface units that are required for diverse broadband applications. Such applications would include cable television, telephony, and other applications that rely on broadband networks. Coaxial residential network last mile, or "drop" cables, supply unregulated ac power to individual homes that can be adapted by power supplies to serve a variety of needs.

Complex outdoor networks are sometimes susceptible to power interruptions, so it is advantageous to use power supplies that are able to anticipate input power fluctuations. It is known that the linear mode of operation is advantageous for minimizing noise that may cause incorrect readings for monitoring applications. Conversely, the high current requirements of normal operation are best served by the power conversion efficiency of the switching power mode. "Dual regulator mode" power supplies have the ability to switch between linear and "switching", or "pulsating" modes. An example of a dual regulator method is disclosed in U.S. Pat. No. 4,502,152 to Sinclair. Sinclair discloses the basic design of a power supply circuit that includes a high current switching regulator and a low current linear regulator feeding a common regulated output supply rail. U.S. Pat. No. 5,083,078 to Kubler is another dual regulator method adaptable, in particular, for use in motor vehicle applications. Both examples are useful for the basic purpose of dual mode operation, but do not contemplate, and are not best suited to, the variable input power adaptability requirements for a coaxial cable network because they cannot automatically switch modes of output. Also, neither Sinclair nor Kubler contemplates adjusting modes based on variations in the power source voltage magnitude.

While the dual regulator method is advantageous, circuit complexity makes such methods less reliable at producing stable outputs than conventional power supplies. Further, the complexity required for dual regulators arranged in a parallel method (as in Sinclair) causes packaging constraints. U.S. Pat. No. 5,034,676 to Kinzalow discloses a direct current power supply circuit having automatic linear and switching modes. The circuit in Kinzalow is designed using a three terminal linear voltage regulator as a control element. Specifically, the circuit is designed to operate in an environment where input to output voltage drop is less than two volts. Such capability is useful in automotive applications where the SAE measured range of an automobile alternator is within 2–5 volts of the voltage required for many automotive electronics. While Kinzalow is suitable for it's intended purpose of supplying loads that require narrowly different power levels from those supplied from a singular relatively constant magnitude unregulated source, it does not improve upon higher magnitude conversion, or "step down" methods suitable to regulate (or monitor) dual power source networks drop cables. Kinzalow is designed to adapt to the changing power requirements of the load (e.g., power requirement differences between regular operation and standby and monitoring modes) rather than variations in the power source.

It is further noted that speed is critical for adapting to power source variations. U.S. Pat. No. 5,548,204 to Armstrong II discloses a method for a linear/switching regulator circuit that is implemented by a reconfigurable integrated circuit. While the invention can be reconfigured to accommodate various loads, the complexity involved in implementing a reconfigurable integrated circuit chip has a possible unintended effect of reducing the accuracy of voltage measurements and thus, could adversely affect response time. Armstrong II, like Kinzalow, is also configured to respond to variation in the load rather than the power source.

Therefore, there is a need in the art for a voltage regulating power supply system that is operable to output a regulated dc voltage in linear and switching modes based on the status of a dual power source coaxial cable network.

There is also a need in the art for a small size, low current power supply that can efficiently convert power for use by home utility interfaces from an unregulated power source such as a coaxial residential network drop cable, thus eliminating the need to draw power from a conventional power grid.

Finally, there is a need in the art for a small size, low current power supply that is able to detect a dual power source coaxial cable network's operating status and automatically switch between a pulsating mode, for normal operations when high efficiency power conversion is necessary, and a linear mode, for monitoring when a primary power source becomes disconnected from the network, based on the detected status.

SUMMARY OF THE INVENTION

The present invention overcomes the above described problems in the prior art by providing a dual power source coaxial cable network mode regulating system for determining whether a power source is present. The present invention consists of a primary power source for producing a first voltage and a secondary power source for producing a second voltage. A common input combines the first voltage with the second voltage. A circuit produces an output voltage in either linear mode or pulsating mode based on the magnitude of the combined first and second voltages received from the common input.

Objects, features and advantages of the present invention will become apparent upon reading the following detailed description of the preferred embodiments of the invention, when taken in conjunction with the accompanying drawings and the appended claims.

DETAILED DESCRIPTION

Figure 1:
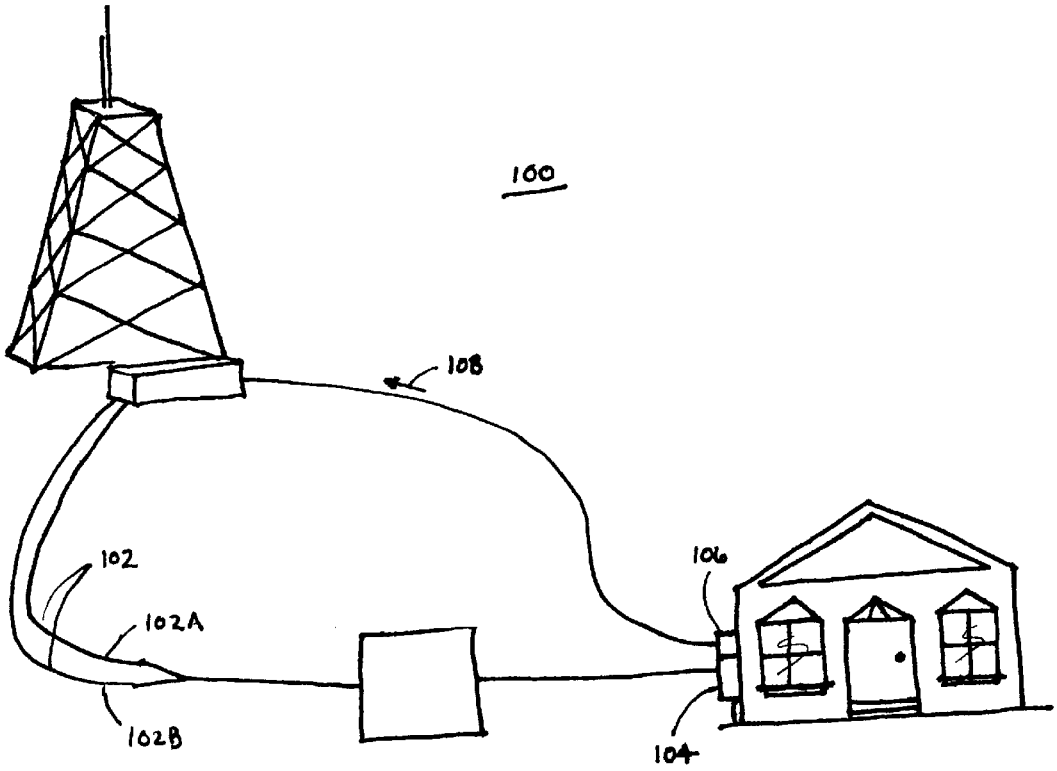
FIG. 1 is a diagram of an exemplary environment for implementing the present invention illustrating a cable television transmission network.

Although suitable for alternative uses, the present invention is designed to operate within a cable television transmission network. Referring now in detail to the drawings in which like numerals refer to like parts throughout the several views, FIG. 1 is a diagram of an exemplary environment for implementing the present invention illustrating a cable television transmission network. Cable television transmission networks 100 can be configured to transmit electrical power. The present invention can be modified for various input and output power requirements, however, the preferred embodiment described below is optimized for extracting power from a coaxial cable 102 with dual power sources, a primary 102A and a secondary 102B, in order to supply a home utility interface (i.e., a cable box) 104 with the best output power mode depending on network conditions and to supply such power without having to utilize a conventional power grid.

Preferably, the first (primary) power source will have an output voltage greater magnitude than the secondary power source. Home utility interfaces 104 contain electronics for, among other applications, cable television and telephony services. Maximum power conversion efficiency is needed to supply these often power-intensive applications. Because power networks occasionally fail, home utility interfaces 104 may also contain network monitoring circuits 106 to report power outages 108. Since accuracy is of primary concern for network monitoring, low noise power conversion is paramount in this instance. The cable television transmission network 100 envisioned in the preferred embodiment includes a combined power source of up to 90 VAC on the drop cable main conductor. The 90 VAC is the combined voltage from the first and second power source. The first power source is intended to power cable box power-intensive applications and is preferably 75 VAC . The second power source is preferably 15 VAC and is intended to power low level current systems, particularly network monitoring circuits. In this embodiment, the present invention will deliver 5 VDC at 10 mA from the 90 VAC power source at very high efficiency. For lower input voltages (secondary power source only), the present invention will deliver a regulated output voltage with a very low noise component.

Figure 2:
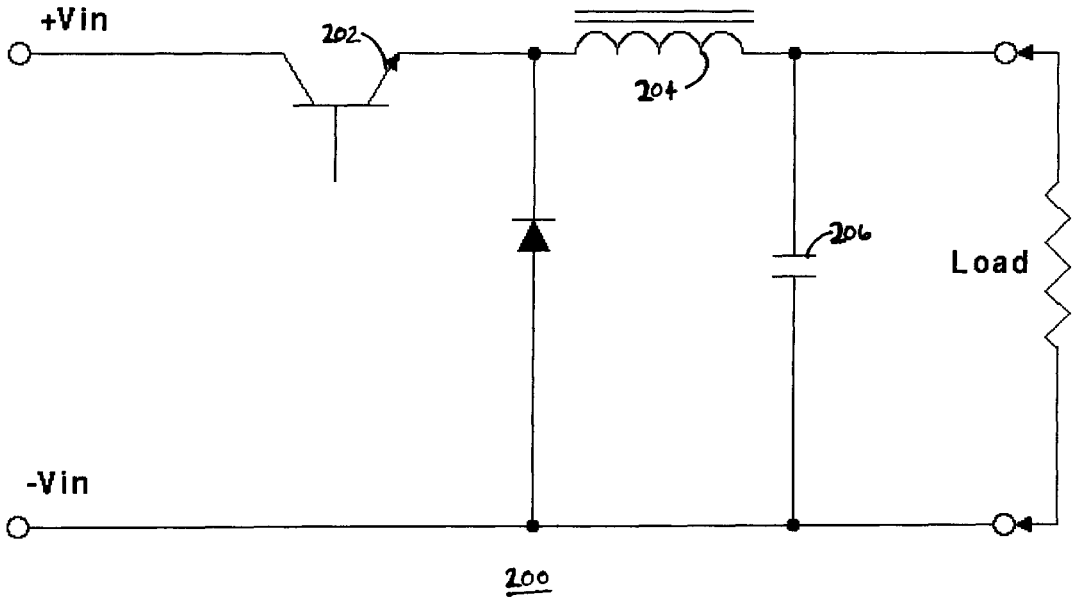
FIG. 2 is a circuit diagram of a buck-type switching regulator.

FIG. 2 is a circuit diagram of a buck-type switching regulator. Aspects of the present invention are based on the design of the "buck" type switching regulator. A buck type switching regulator converts a high unregulated input voltage (such as the power tap voltage) into an application specific lower regulated voltage often for powering electronic components such as those found in a home utility interface. The buck type switching regulator 200 comprises a transistor 202 that supplies energy storage components, consisting of an inductor 204 and capacitor 206 combination, with regulated voltage pulses when switched on. A diode provides a path for voltage stored in the L-C combination when the transistor is switched off.

Figure 3:
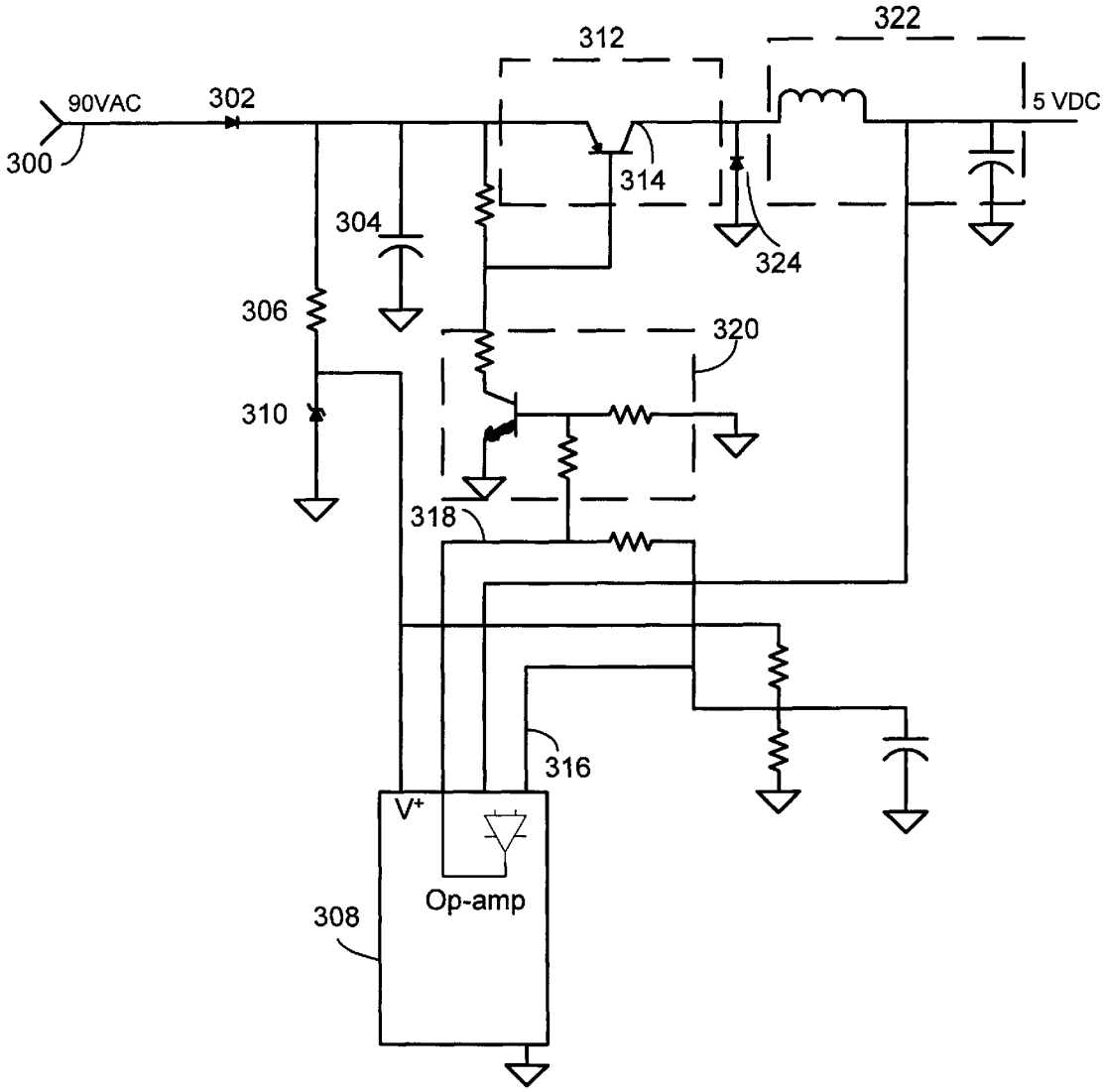
FIG. 3 is a circuit diagram that illustrates an exemplary embodiment of the present invention which implements a dual mode power supply.

FIG. 3 is a circuit diagram that illustrates an exemplary embodiment of the present invention which implements a dual mode power supply. The present invention comprises a control mechanism that automatically changes the regulated dc voltage at the output between linear and pulsating mode depending on the availability of both power sources. As stated above, the preferred 90 VAC input unregulated ac voltage is a combination of the primary and secondary power source voltages. A disruption in the primary input power source will cause the input unregulated ac voltage to be reduced, allowing only a small amount of power to flow for monitoring purposes. When the input unregulated ac voltage drops below a predetermined magnitude (or drops to zero), such an event will cause a reduction in output current, to 1 mA in this case, and cause the present invention to automatically switch to a noise reducing linear mode. Conversely, when the primary power source returns to normal operation or an input from the predetermined minimum level up to 90 VAC , the present invention will automatically switch back to an efficient pulsating mode and produce a 10 mA output current.

In operation, the unregulated ac voltage of 90 VAC is applied at the input terminal 300 and is converted to an equivalent dc voltage by the half-wave rectifier 302. In the preferred embodiment, a filter 304 is used to filter out the rectified signal for accuracy. Such filtering methods, and the advantages thereof, are known to those skilled in the art. The resulting equivalent dc voltage, after being rectified and filtered, should be about 90 VDC. A resistor 306 is utilized to provide a small current to power a comparator 308, preferably implemented by an op amp device, which produces a control signal by a method described in detail below. In order to prevent a power overload, a zener diode 310 is used to prevent the comparator 308 supply voltage from exceeding 12 volts.

The equivalent dc voltage is next applied to the regulator 312 which is a circuit that converts the equivalent dc voltage into a regulated dc voltage for output. As stated above, aspects of buck type switching regulator design are utilized for the present invention. Within the regulator 312 , a switch device 314 (preferably implemented by a transistor), will, depending on it's operating mode, either be in pulsating or linear mode. In order to determine the correct operating region, a reference voltage 316 is applied, along with the regulated dc voltage, to the comparator 308 inputs. In the preferred implementation, the regulated dc voltage and the reference voltage 316 are applied to the inverting and non-inverting inputs of the op amp respectively. The comparator 308 produces a control signal 318 that is used to control the switch device 314 for the selection (or continuation) of an output mode. A various circuitry 320 provides a level and polarity interface between the comparator 308 and the switch device 314.

In the pulsating mode, the switch device 314 supplies variable duty cycle pulses to energy storage components 322 in order to produce a pulsating regulated dc voltage output. The energy storage components 322 respond to the voltage pulses by producing an exponentially growing current. When the voltage pulse switches off, the energy storage components' 322 current begins to decay, but does not go to zero before another voltage pulse is applied by the switch device 314. Therefore, a dc current is always present in the energy storage components 322. The dc current charges a capacitor (also within the energy storage components 322) to produce the pulsated regulated dc voltage. In linear mode, a diode 324 provides a low voltage, low noise path for energy storage component current.

If the regulated dc voltage is in pulsated mode, it will be known to a network monitoring circuit 106 that the network is functioning normally. However, if the regulated dc voltage is in linear mode, the network monitoring circuit 106 will signal back to the central transmitting hub 108 that the primary voltage source is not present.

Therefore, the present invention is able to automatically switch between linear and pulsating output voltage modes based on the availability of the primary and secondary power supplies. The pulsating mode is utilized when at least the primary power is available for providing high efficiency power conversion to supply loads, including, but not limited to residential interface units, while the linear mode is utilized when only the secondary power supply is available for providing low voltage current to allow monitoring circuits and other low voltage applications to operate with improved noise reduction. Such monitoring circuits can be operable to report the status of a cable television transmission network back to a central transmitting hub.

While this invention has been described in detail with particular reference to preferred embodiments thereof, it will be understood that variations and modifications can be effected within the scope of the invention as defined in the appended claims.

We claim:

1. An ac-dc dual output mode power supply for converting an unregulated ac voltage from a coaxial cable power source into a regulated dc voltage, wherein the output mode, being either a linear mode or a pulsating mode, is selected based on the magnitude of said unregulated ac voltage, said power supply comprising:

an input terminal for receiving said unregulated ac voltage;

a half-wave rectifier for converting said unregulated ac voltage into an equivalent dc voltage;

a regulator for converting said equivalent dc voltage into a regulated dc voltage;

a reference voltage;

a comparator for comparing said regulated dc voltage with said reference voltage and for producing a control signal based on said comparison; and a switch device for switching said output mode of said regulated dc voltage between said linear mode and said pulsating mode based on said control signal.

2. The ac-dc dual output mode power supply of claim 1, wherein said regulator comprises a buck-type switching regulator for converting said equivalent dc voltage into a lower value regulated dc voltage.

3. The ac-dc dual output mode power supply of claim 1, wherein a portion of said equivalent dc voltage is utilized to power said comparator.

4. The ac-dc dual output mode power supply of claim 1, wherein said switch device has a linear operating region for outputting said regulated dc voltage in said linear mode.

5. The switch device of claim 4, wherein said linear operating region is invoked when the magnitude of said control signal is at or below a predetermined threshold value.

6. The ac-dc dual output mode power supply of claim 1, wherein said switch device has a pulse operating region for outputting said regulated dc voltage in said pulsating mode.

7. The switch device of claim 4, wherein said pulse operating region is invoked when said control signal is above a predetermined threshold value.

8. A method for converting an unregulated ac voltage from a coaxial cable power source into a regulated dc voltage, wherein an output mode, being either a linear mode or a pulsating mode, is selected based on the magnitude of said unregulated ac voltage, said method comprising:

receiving said unregulated ac voltage;

converting said unregulated ac voltage into an equivalent dc voltage;

converting said equivalent dc voltage into a regulated dc voltage;

comparing said regulated dc voltage with a reference voltage and producing a control signal based on said comparison; and switching said output mode of said regulated dc voltage between said linear mode and said pulsating mode based on said control signal.

* * * * *